US006318134B1

(12) United States Patent
Mossberg et al.

(10) Patent No.: US 6,318,134 B1
(45) Date of Patent: Nov. 20, 2001

(54) SAFE LOCKING MECHANISM

(75) Inventors: Jonathan E. Mossberg, Branford; David P. Boisvert, Southington, both of CT (US)

(73) Assignee: Mossberg Safe Systems, Inc., North Haven, CT (US)

( * ) Notice: Subject to any disclaimer, the term of this patent is extended or adjusted under 35 U.S.C. 154(b) by 0 days.

(21) Appl. No.: 09/352,568

(22) Filed: Jul. 13, 1999

Related U.S. Application Data

(60) Provisional application No. 60/092,746, filed on Jul. 14, 1998.

(51) Int. Cl.[7] ..... E05B 73/00

(52) U.S. Cl. ..... 70/63; 70/278.1; 70/333 R; 70/386; 292/144; 292/183; 292/252; 292/254

(58) Field of Search ..... 70/63, 278.1, 386, 70/58, 71, 192, 277, 333 R; 292/144, 183, 252, 254; 109/59 R

(56) References Cited

U.S. PATENT DOCUMENTS

| | | | | |
|---|---|---|---|---|
| 1,784,935 | * | 12/1930 | Johnson | 292/254 |
| 2,186,903 | * | 1/1940 | Gleason | 292/254 |
| 2,384,276 | * | 9/1945 | Burbridge | 292/254 |
| 2,716,567 | * | 8/1955 | Turcott | 292/144 |
| 2,729,486 | * | 1/1956 | Evans | 292/254 X |
| 4,132,439 | * | 1/1979 | Millar | 70/279.1 X |
| 4,435,966 | * | 3/1984 | Craig | 292/DIG. 37 X |
| 4,651,544 | * | 3/1987 | Hungerford | 70/63 |
| 4,800,822 | | 1/1989 | Adkins | 109/19 |
| 4,902,052 | * | 2/1990 | Laine | 292/254 X |
| 4,934,162 | * | 6/1990 | Rasch | 292/252 X |
| 5,249,831 | * | 10/1993 | Maniaci | 292/2 X |
| 5,329,865 | * | 7/1994 | McWard | 70/63 X |
| 5,416,826 | | 5/1995 | Butler | 379/40 |
| 5,460,020 | * | 10/1995 | Hungerford | 70/63 |
| 5,518,282 | * | 5/1996 | Sawada | 292/252 |
| 5,603,534 | * | 2/1997 | Fuller | 292/2 |
| 5,791,172 | * | 8/1998 | Deighton et al. | 70/63 |
| 5,881,584 | * | 3/1999 | Brunoski et al. | 70/68 |
| 5,901,581 | | 5/1999 | Cordero | 70/63 |
| 6,098,433 | * | 8/2000 | Maniaci | 70/278.1 |

FOREIGN PATENT DOCUMENTS

| | | | | |
|---|---|---|---|---|
| 229813 | * | 4/1959 | (AU) | 292/254 |
| 205565 | * | 1/1909 | (DE) | 292/254 |
| 276237 | * | 6/1913 | (DE) | 292/144 |
| 264341 | * | 9/1913 | (DE) | 292/144 |
| 3841573 | * | 6/1990 | (DE) | 70/277 |
| 0485248 | * | 5/1992 | (EP) | 70/277 |
| 663850 | * | 4/1929 | (FR) | 292/254 |
| 805914 | * | 12/1936 | (FR) | 292/144 |
| 2533612 | * | 3/1984 | (FR) | 292/144 |

* cited by examiner

*Primary Examiner*—Lloyd A. Gall
(74) *Attorney, Agent, or Firm*—St. Onge Steward Johnston & Reens LLC

(57) ABSTRACT

A lockable enclosure including a safe, a suitcase, a briefcase, and the like has an interior sized to receive articles and an electronic key assembly actuating a cam mechanism upon entry of a preprogrammed entry code. The cam mechanism has a cam that depresses a release lever of the a latch assembly to a position, wherein the latch assembly disengages from the lockable enclosure to allow a door to swing in an open position so as to enable access to the interior of the lockable enclosure.

20 Claims, 5 Drawing Sheets

10
14
27
60
62
64
66
68
70
72
74
76
77
80
81
82
83
84
85
88
90
96

SAFE LOCKING MECHANISM

PRIOR APPLICATION

This application is a continuation-in-part of Provisional Application of U.S. No. 60/092,746 filed on Jul. 14, 1998 and which is fully incorporated herein by reference thereto.

FIELD OF THE INVENTION

The present invention relates to lockable enclosures, and, in particular, to lockable enclosures which have electronically operated locks. Specifically, the present invention relates to latch assemblies capable of preventing the electronically operated locks of lockable enclosures from an accidental release.

BACKGROUND OF THE INVENTION

It is difficult to imagine a modern life without lockable enclosures and, particularly, portable lockable enclosures. Such lockable enclosures including, for example, a briefcase, a suitcase, a portable safe and the like are typically used for storing and safe transportation of documents, jewelry, personal belongings and the like. Practically, all of these enclosures have latch assemblies of different types, some of which employ electronically operated locks that serve to prevent unauthorized access to an enclosure's interior. A reliable latch assembly for a lockable enclosure becomes even more important when the latter stores a firearm.

The art does supply a number of small portable safes, which may be easily carried by owners while they are travelling.

U.S. Pat. No. 5,416,826 to Butler discloses an electronically operated gun safe which has a drawer removably positioned with a housing to move to an open position to allow access to the contents of the drawer. This patent further describes an electronic code entry means and a processor means positioned in an interior and responsive the electronic code means for releasing a locking means to provide access to the drawer.

U.S. Pat. No. 4,800,822 to Adkins discloses a spring loaded ejectable drawer containing a firearm and slidably mounted within a housing. The drawer bears against a closed door of the housing, so that, upon opening of the door, the ejectable drawer is forced outwardly to present the firearm for grasping.

U.S. Pat. No. 5,901,589 to Cordero discloses a storage body for receiving a firearm and formed with a door, a plurality of grooves inside the storage body surrounding the door to permit it to move inwardly to an opening position. This patent further describes a spring biasing means for holding the door tightly against the storage body that is releasable by a hidden latch mechanism accessible from outside the body and opening the door.

It has been noticed that some of the locking mechanisms tend to voluntary release its latches when the portable safes are accidentally dropped or even deliberately positioned on its rear portions.

SUMMARY OF THE INVENTION

With a safe including a lockable enclosure that has an interior sized to receive valuables such as guns and the like and that is provided with an inventive latch assembly, some of the drawbacks of the prior art may be overcome. The latch assembly has a means for preventing accidental release of the latch assembly when the lockable enclosure is positioned on its rear portion.

According to another aspect of the invention, the lockable enclosure is provided with a cam mechanism positioned in an interior of the lockable enclosure and operated to controllably release the latch assembly.

In accordance with another feature of the invention, the lockable enclosure has an electronic key assembly for permitting entry of a key code to enable the cam mechanism.

It is therefore an object of this invention to provide an improved lockable enclosure overcoming some of the disadvantages of the known prior art.

Still another object of the invention is to provide a lockable enclosure with a latch assembly that is secured against accidental release when the lockable enclosure is positioned on its rear portion.

Yet another object of the invention is to provide a lockable enclosure with a cam mechanism releasing the latch mechanism in response to a predetermined signal.

Still another object of the invention is to provide a lockable enclosure with an electronic key assembly enabling the cam mechanism.

The above and other objects, features and advantages will become more readily apparent from the following detailed description of the invention and accompanying drawings, which set forth an illustrative embodiment of the invention.

DETAILED DESCRIPTION OF THE INVENTION

Figure 1:
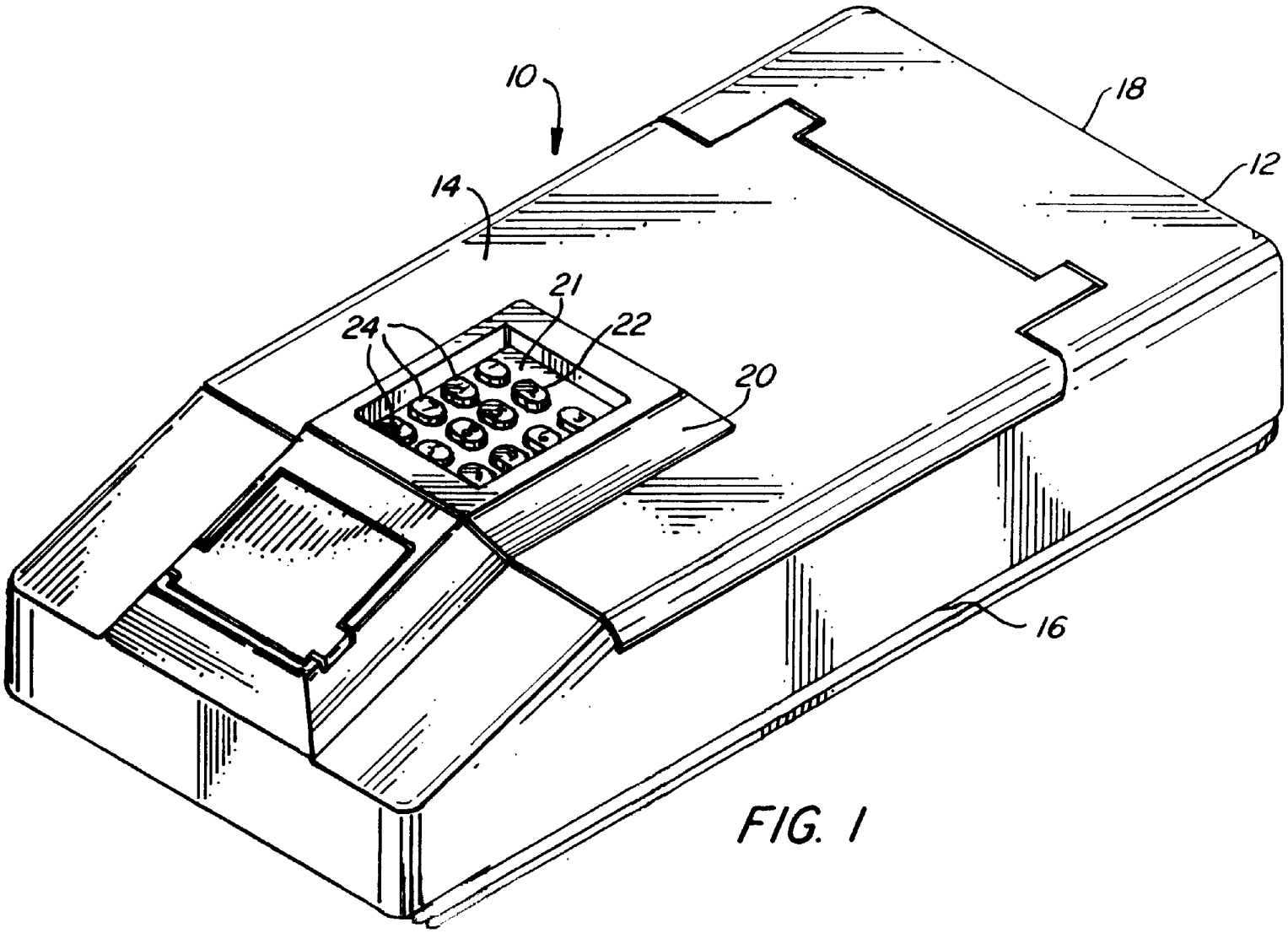
FIG. 1 isometric view of a lockable enclosure positioned on its bottom.
Figure 2:
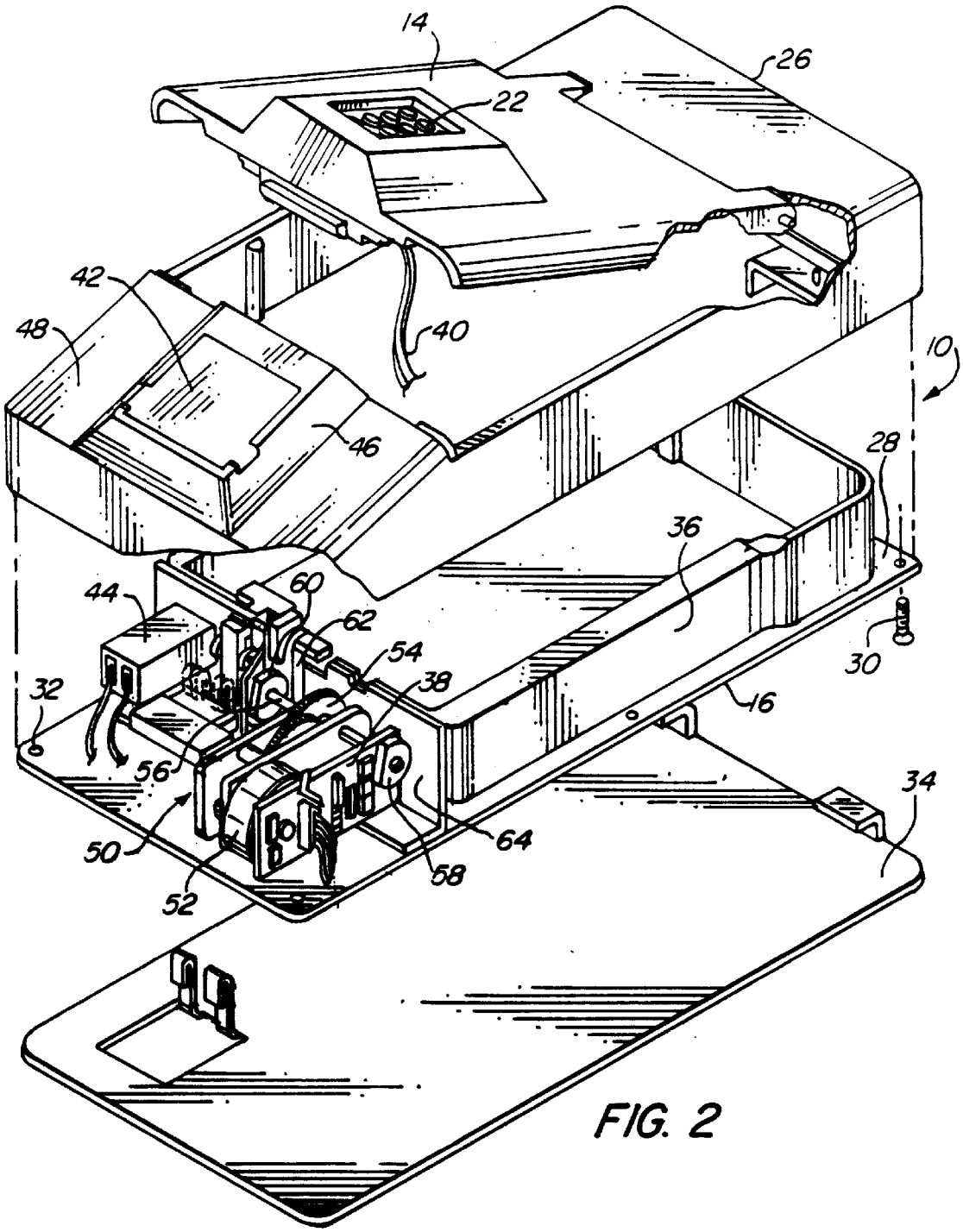
FIG. 2 is an exploded view of the lockable enclosure of FIG. 1.
Figure 3:
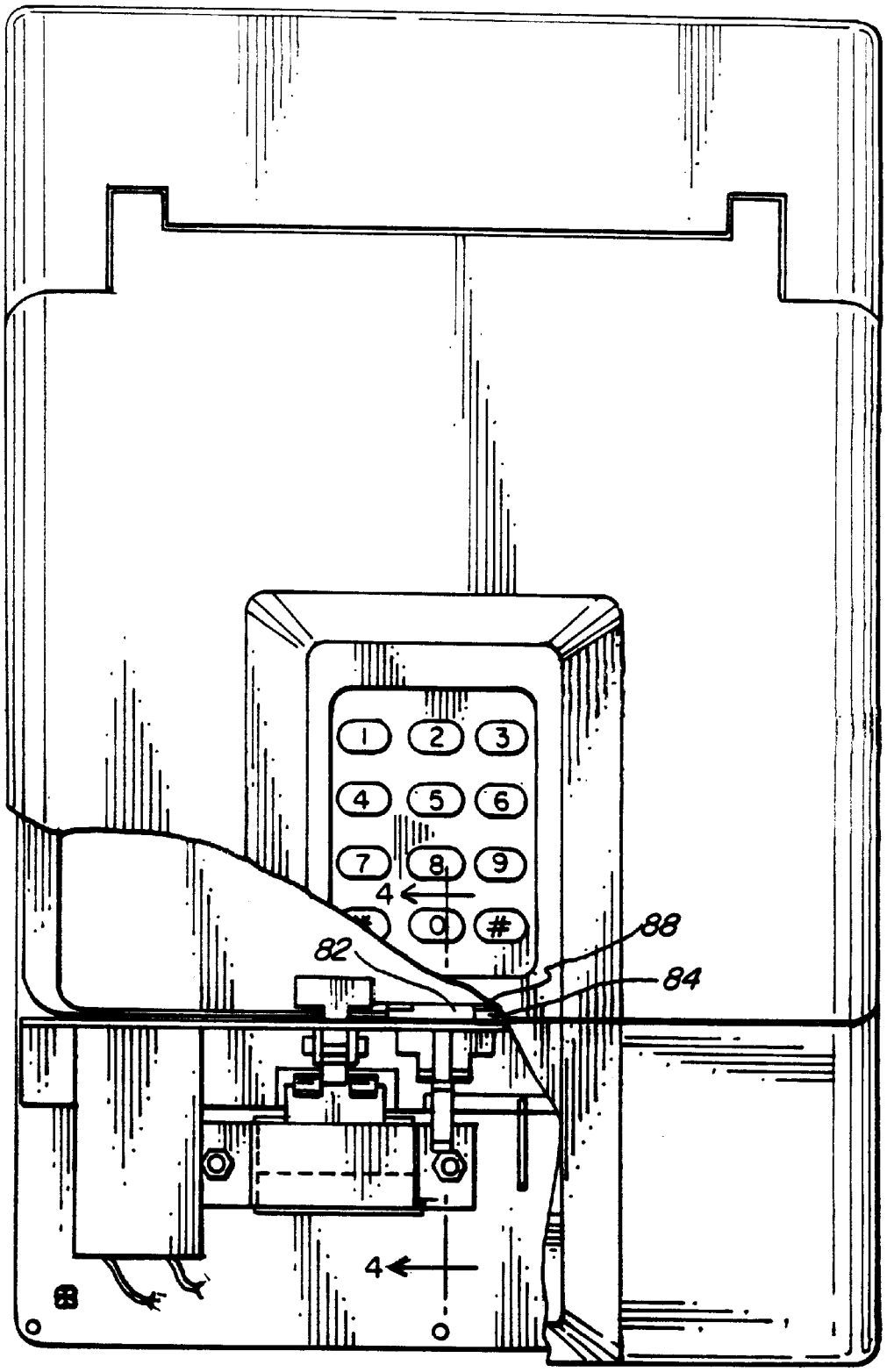
FIG. 3 is a top view of the safe shown in FIG. 1 with a portion cut away for clarity.

Referring to FIGS. 1–3, a lockable enclosure 10 is a self-contained, electronically controlled containment system, such as, for example, a safe for storing a variety of valuables including guns and the like. The safe 10 can be positioned on any generally flat surface juxtaposed with either the safe's bottom 16 or its rear side 18.

FIG. 1 illustrates the safe 10 shown in its locked state and having a solid cast enclosure 12. A lid 14, sometimes referred to as a door, is mounted to the enclosure 12 to move to an open position as shown in FIG. 2. The safe further has a protrusion 20 formed with a recess 21 that receives a keypad system 22 including a plurality of keys or buttons 24 used to customize a user's personal access code. As better seen in FIG. 3, the buttons are provided with standard numeric digits. By dialing the personal access, a user may access an interior of the enclosure 12, as will be explained hereinbelow.

As shown in FIG. 2, the safe 10 has a top wall 26 and a receptacle part 28, which parts when assembled form an interior of the safe sized to receive the valuables. Any suitable fasteners may do assembly of the top wall and receptacle part 28, for example, screws 30 traversing aligned holes 32 that are formed on the top wall and the receptacle part. The safe 10 further has a mounting bracket 34 for mounting the safe 10 to a surface if the safe 10 is intended to be secured in a predetermined location. The mounting bracket is detachably secured to the bottom 16 of the safe 10 and is described in detail in a coopending application Ser. No. 09/352,220 filed concurrently with the present application. The enclosure further has a cushioned receptacle 36 secured to the receptacle part 28 and made of light durable material, for example, plastic.

Turning to FIG. 2, the safe 10 in accordance with one aspect of the invention, has an electronic key assembly including the keypad 22 and a processor 38, which is only shown diagrammatically and known in the art. Typically, the processor 38 stores key code data and has an operating program located in a digital memory that is located within the processor. When a key code has been entered, it is transferred to the processor 38 via a ribbon cable 40. If the key code matches the key code data that has been stored in the digital memory, the electronic key assembly actuates a cam mechanism as will be explained hereinbelow. The electronic key assembly also includes an alarm circuitry turning on a sound system (not shown here) indicating that an unauthorized code has been entered. This sound system is also set off when either of main 42 and spare 44 batteries is low. The main battery 42 is placed in a recessed seat 46 formed in a front portion 48 of the top wall 26. The keypad 22 is provided with a keypad back light that is activated by pressing any of the keys 24 before the personal code is entered.

Although the keypad 22 and the main battery 42 are shown to be formed in respective indented regions of the top wall 14, they may alternatively be mounted in one or more of the other outer enclosure walls provided it is exposed to the exterior of the enclosure 12 and is easily accessible by a user.

As mentioned above, according to another feature of the invention, the electronic key assembly actuates the cam mechanism generally indicated as 50 as seen in FIG. 2. The key assembly includes a low rpm motor 52 actuated by the processor 38 in response to the correct key code and a reduction gear train 54 translating rotational motion of the motor's shaft to an output shaft 56. The output shaft 56 has two cams 58, 60 mounted rotatably on this shaft so that the cam 60 juxtaposed with a release lever 62 may actuate it.

The release lever 62 is mounted on an L-shaped support 64 extending between opposite sides of the receptacle part 28 and extending from this part to provide a mounting surface for the spare battery 44 and the release lever 62. The support 64 also serves as a reinforcing surface for the cushioned receptacle 36.

As shown in FIG. 2, the enclosure is provided with a pair of pins, each mounted on a side wall and extending toward the opposite wall. Each of the pins has a torsion spring 68, one end of which is braced against the pin.

Figures 3A, 4, 5:
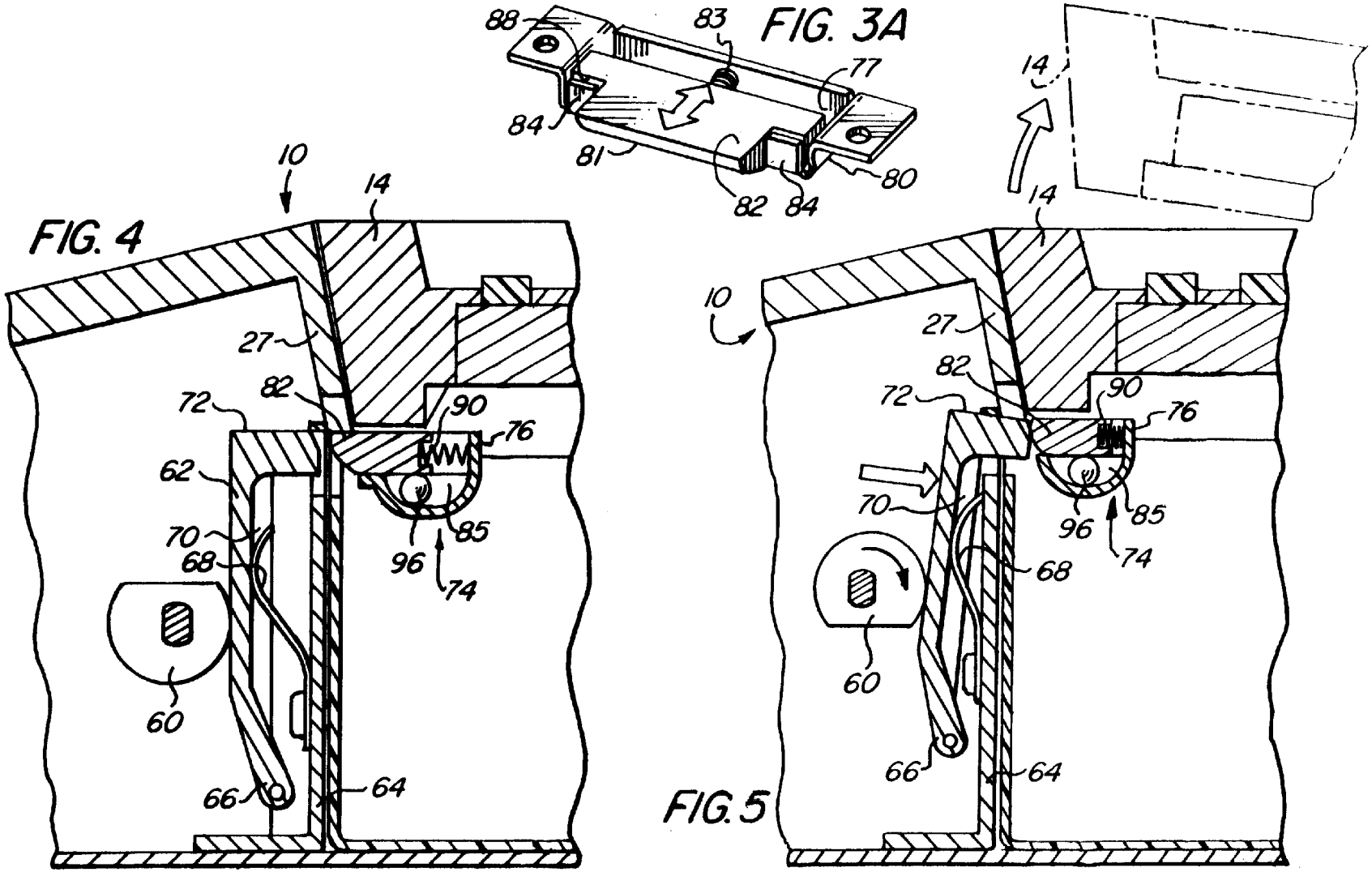
FIG. 3A is a perspective view of a latch assembly.
FIG. 4 is a cross sectional view of the latch assembly shown in its engaging position corresponding to a locked state of the lockable enclosure.
FIG. 5 is a cross sectional view of the latch assembly similar to the one shown in FIG. 4 and illustrating the latch assembly in its release position.
Figure 6:
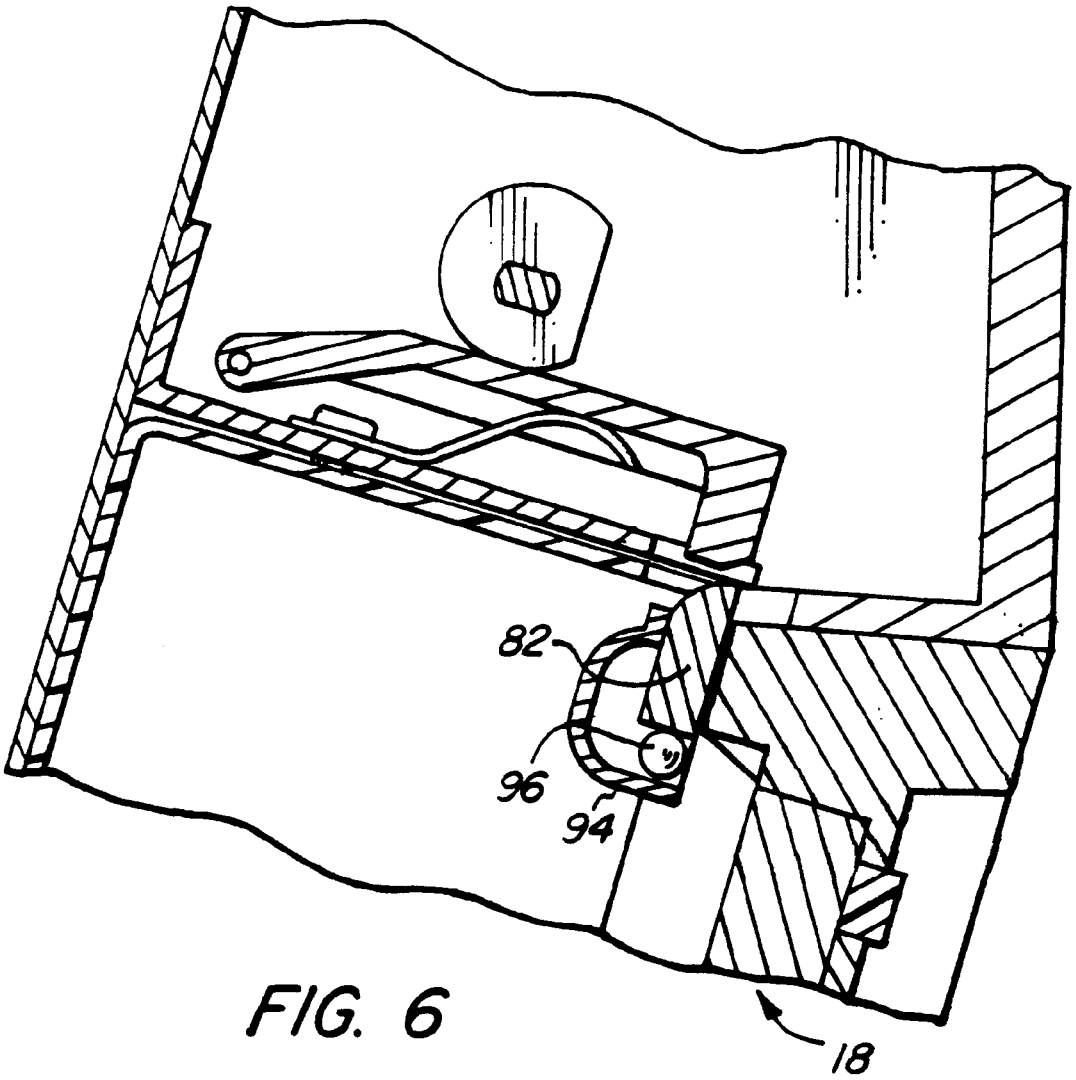
FIG. 6 is a cross sectional view of the latch assembly provided with a stop that prevents accidental release of the lath assembly when the lockable enclosure is positioned on its rear portion.

Referring to FIGS. 4–6, the release lever 62 is preferably made of resilient material, for example, plastic and is mounted pivotally on the support 64 to swing about a fulcrum 66 formed on a lower end of the release lever. To provide a continuous contact between the cam 60 and the release lever 62 a spring element 68 is braced against the L-shaped support 64 and extends toward the release lever 62 to bias it against the cam 60. Thus, a cam follower 70 of the release lever follows displacement of the cam 60 bringing an outer T-shaped end 72 (FIG. 3) of the release lever into engagement with a latch assembly 74, as will be explained hereinbelow.

According to another aspect of the invention, the latch assembly generally denoted as 74, is mounted to an underside of the door 14 and extends under a flange 27 of the top wall 26 in a closed position of the door 14, as shown in FIG. 4.

Particularly, the latch assembly 74 is comprised of a bracket 76 having generally a U shape. A plate 78, better seen in FIG. 5, covers the bracket 76 to form a compartment 77, which is defined between a bottom 80 of the bracket and the plate 78. The bracket and the plate 78 are formed with aligned holes receiving fasteners (not shown) for attaching the latch assembly 74 to the underside of the door 14. The compartment 77 receives a latch 82 and a spring element 83 that biases the latch 82 outwardly from the bracket. In order to arrest displacement of the latch from the compartment 77, FIGS. 3 and 3A illustrate the bottom 80 of the bracket 76 having end portions 84 extending toward the plate 78. These portions 84 form stops, which cooperate with recessed portions 88 of the latch 82 in the closed position of the door 14, and allow only a beveled edge 81 (FIG. 5) of the latch 82 to extend over the bracket toward the flange 27 of the enclosure. A rear portion of the latch 82 is formed with a pair of spaced grooves 90 (only one is shown) which receive ends of the spring elements 83 respectively. Opposite ends of the spring elements urge against a rear wall of the bracket.

The bottom 80 of the latch assembly 74 has a cavity 85 which is formed substantially midway between the recessed portions 88 of the latch 82 and extends downwardly therefrom and between a front edge 92 of and a rear wall 94 of the bracket 76. As a result, space formed between the latch 82 and the cavity 85 receives a ball bearing 96 that is freely displaceable in the cavity under the latch 82 in a substantially horizontal position of the safe 10 shown in FIGS. 4 and 5.

Since the safe 10 is portable and can be used for travel or relocation, the user may either accidentally drop the safe on its rear side 18 (FIG. 6) or intentionally position the safe on this rear side. In this position of the safe, the ball bearing 96 freely rolls to occupy space between the rear wall 94 of the bracket 76 and a rear side of the latch 82, as shown in FIG. 6 to prevent rearward displacement of the latch 82.

Although the cam mechanism 50 and the latch assembly 74 have been described to be mounted to the enclosure 12 and to the door 14 respectively, it is clear that their respective positions can be easily reversed.

The safe operates in the following manner. Upon placing valuables in the cushioned receptacle 36, the user simply pushes the door 14 downwardly to its closed position. During angular displacement of the door 14, the flange 27 of the enclosure's top wall 26 comes in contact with the beveled edge 81 of the latch 82 that retracts into the compartment 77 of the bracket 76. Having reached a closed position, the latch, under the action of the spring force of spring elements 83, advances away from the rear wall 94 of the bracket to abut an underside of the flange 27, thus engaging the latch with the enclosure.

To open the safe, the user dials the access code activating the processor 38 which, in turn, actuates the cam 60 to rotate at a 180° angle from a position shown in FIG. 4 to a position shown in FIG. 5. In this latter position the release lever 62 overcomes a force exerted by the leaf spring 68 to displace the latch rearwardly toward the back wall 94 of the bracket 76, thus releasing the latch assembly 74 from the enclosure. As a result, the door 14 swings up to its open position.

Although the latch assembly is described to operate the safe 10, it is easy to see that such latch assembly can reliably lock a variety of suitcases, briefcases, bags and the like. It is also possible to utilize the disclosed latch assembly with any lockable item that can be placed in a position in which voluntary release of a latch is possible.

It is intended that the flowing claims defined the scope of the invention and the structures within the scope of these claims and their equivalents be covered thereby.

What is claimed is:

1. A safe for retaining articles such as guns and the like comprising:

an enclosure formed with an interior sized to retain the articles;

a door mounted to the enclosure to enable access to the interior;

a latch assembly located within the interior between the enclosure and the door and releasably engaging the enclosure in a closed position of the door, the latch assembly having a housing, the housing being provided with a bottom, which has a cavity, a ball bearing received in the cavity and freely displaceable therein;

a cam mechanism mounted within the interior of the enclosure and juxtaposed with the latch assembly in the closed position of the door; and an electronic key assembly for permitting entry of a key code and operatively connected to the cam mechanism, the cam mechanism being actuatable in response to the entry of the key code to release the latch assembly from engagement with the enclosure and to open the door.

2. The safe defined in claim 1 wherein the latch assembly further comprises a latch slidably mounted in the housing, and a spring element resiliently biasing the latch away from the housing which is removably mounted to an underside of the door.

3. The safe defined in claim 2 wherein the housing has a rear wall, the bottom facing the interior of the enclosure and the cavity extending from the rear wall.

4. The safe defined in claim 3 wherein the latch and the rear wall of the housing form a space in an unloaded state of the spring element, the ball bearing filling the space to arrest displacement of the latch toward the rear wall upon placing the enclosure on its rear portion thereby preventing accidental disengagement of the latch assembly from the enclosure.

5. The safe defined in claim 1 wherein the electronic key assembly includes an electronic code keypad located on an exterior of the enclosure for entering the key code, and a processor positioned in the interior and responsive to the key code to enable the cam mechanism.

6. The safe defined in claim 5 wherein the processor includes a circuitry for setting the key code and for activating an alarm when a battery is low and when attempts are made to enter unauthorized key codes.

7. The safe defined in claim 1 wherein the enclosure further has two spaced pins fixedly mounted on opposite side walls of the enclosure and extending toward each other, the door having two torsional springs spaced apart and mounted to the pins to bias the door in its open position.

8. A safe for retaining articles such as guns and the like, comprising:

an enclosure formed with an interior sized to retain the articles;

a door mounted to the enclosure to enable access to the interior;

a latch assembly located within the interior between the enclosure and the door and releasably engaging the enclosure in a closed position of the door, the latch assembly having:

a housing removably mounted to an underside of the door, said housing having a bottom provided with a cavity, and a rear wall, a latch slidably mounted in the housing, a stop received in the cavity and freely displaceable therein, a pair of spaced apart grooves opening toward the rear wall of the housing, two compression springs, each received in the respective groove and braced against the rear wall and the latch to resiliently bias the latch away from the housing;

a cam mechanism mounted within the interior of the enclosure and juxtaposed with the latch assembly in the closed position of the door; and an electronic key assembly for permitting entry of a key code and operatively connected to the cam mechanism, the cam mechanism being actuated in response to the entry of the key code to release the latch assembly from engagement with the enclosure and to open the door.

9. The safe defined in claim 8 wherein the latch has an outer beveled edge formed with a pair of recessed end portions, the housing further having a pair of spaced stops cooperating with the recessed end portions of the latch to enable the beveled edge to extend from the housing in an unloaded state of the spring element and to engage the enclosure.

10. The safe defined in claim 9 wherein the beveled edge is slidably pressed against a top wall of the enclosure enabling the latch to retract rearwardly into the housing while closing the door, the latch being biased from the housing to engage an underside of the top wall upon closing the door.

11. A safe for retaining articles such as guns and the like, comprising:

an enclosure formed with an interior sized to retain the articles;

a door mounted to the enclosure to enable access to the interior;

a latch assembly located within the interior between the enclosure and the door and releasably engaging the enclosure in a closed position of the door, the latch assembly having a housing provided with a bottom, which has a cavity and with a rear wall, a stop received in the cavity and freely displaceable therein;

a cam mechanism mounted within the interior of the enclosure and juxtaposed with the latch assembly in the closed position of the door, the cam mechanism having a release lever pivotally mounted in the interior of the enclosure, and a cam rotatably mounted in the interior and being in continuous contact with the release lever so as to enable it to swing toward and away from the latch assembly; and an electronic key assembly for permitting entry of a key code and operatively connected to the cam mechanism, the cam mechanism being actuated in response to the entry of the key code to release the latch assembly from engagement with the enclosure and to open the door.

12. The safe defined in claim 11 wherein the cam mechanism further comprises a motor and a gear train connected with the motor and having a shaft that receives the cam rotatably fixed with the shaft.

13. A safe for retaining articles such as guns and the like, comprising:

an enclosure having an interior sized to receive the articles and a rear portion;

a door mounted pivotally to the enclosure to enable access to the interior;

a latch assembly releasably engaging the enclosure upon closing the door, the latch assembly having a housing and a ball bearing freely displaceable within the housing; and an electronic key assembly for permitting entry of a key code and cooperating with the latch assembly upon closing the door so as to displace the latch assembly out of engagement with the enclosure in response to the entry of the key code, the ball bearing being displaceable to disable voluntary retraction of the latch assembly within the housing to prevent an accidental release of the enclosure upon placing it on the rear portion.

14. The safe defined in claim 13, further comprising a cam mechanism mounted within the interior of the enclosure, the cam mechanism being juxtaposed with the latch assembly when the door is closed and being actuatable by the electronic key assembly to displace the latch assembly out of engagement upon entering the key code.

15. A safe for retaining articles such as guns and the like, comprising:

an enclosure having an interior sized to receive the articles and a rear portion;

a door mounted pivotally to the enclosure to enable access to the interior;

a latch assembly releasably engaging the enclosure upon closing the door, the latch assembly having a housing and a stop freely displaceable within the housing;

a cam mechanism mounted within the interior of the enclosure, the cam mechanism being juxtaposed with the latch assembly when the door is closed and being actuatable by the electronic key assembly to displace the latch assembly out of engagement upon entering the key code, the cam mechanism having a release lever pivotally mounted in the interior of the enclosure, and a cam rotatably mounted in the interior and being in continuous contact with the release lever so as to enable it to swing toward and away from the latch assembly; and an electronic key assembly for permitting entry of a key code and cooperating with the latch assembly upon closing the door so as to displace the latch assembly out of engagement with the enclosure in response to the entry of the key code, the stop being displaceable to disable voluntary retraction of the latch assembly within the housing to prevent an accidental release of the enclosure upon placing it on the rear portion.

16. The safe defined in claim 15 wherein the cam mechanism further comprises a spring element biasing the release lever toward the cam, and a motor with a reduction gear train receiving the cam that is rotatably fixed on a shaft.

17. The safe defined in claim 15 wherein the latch assembly comprises a spring loaded latch resiliently biased away from the housing.

18. The safe defined in claim 17 wherein the stop is displaceable between the housing and the latch to prevent accidental disengagement of the latch assembly when the enclosure is on its rear portion.

19. A lockable enclosure for retaining articles, the lockable enclosure being selected from the group consisting of a suitcase, a briefcase, and a safe and comprising:

an interior sized to receive the articles;

a housing mounted within the interior of the lockable enclosure;

a latch assembly adapted to engage the lockable enclosure in a closed position thereof and slidably received in the housing;

a cam mechanism mounted within the interior and juxtaposed with the latch assembly in the closed position of the lockable enclosure to controllably displace the latch assembly out of engagement into the housing;

a ball bearing freely displaceable in the housing under a gravitational force to position itself between the housing and the latch assembly so as to arrest retraction of the latch assembly into the housing thereby preventing an accidental release of the lockable enclosure; and an electronic key assembly for permitting entry of a key code and operatively connected to the cam mechanism to actuate it in response to the entry of the key code.

20. The lockable enclosure defined in claim 19 wherein the housing of the latch assembly is mounted to an underside of a swingable door that enables access to the interior of the lockable enclosure, the latch assembly further having a spring loaded latch retractably mounted in the housing to release the latch assembly from engagement with the lockable enclosure.

* * * * *